US010410469B2

(12) United States Patent
Pettie

(10) Patent No.: US 10,410,469 B2
(45) Date of Patent: Sep. 10, 2019

(54) SKILL-ASSISTANCE IN SKILL-BASED WAGERING

(71) Applicant: Troy Pettie, Las Vegas, NV (US)

(72) Inventor: Troy Pettie, Las Vegas, NV (US)

( * ) Notice: Subject to any disclaimer, the term of this patent is extended or adjusted under 35 U.S.C. 154(b) by 0 days.

(21) Appl. No.: 16/262,505

(22) Filed: Jan. 30, 2019

(65) Prior Publication Data

US 2019/0197828 A1 Jun. 27, 2019

Related U.S. Application Data

(63) Continuation-in-part of application No. 15/434,054, filed on Feb. 16, 2017, now Pat. No. 10,217,314.

(51) Int. Cl.
*G07F 17/32* (2006.01)

(52) U.S. Cl.
CPC ..... *G07F 17/3244* (2013.01); *G07F 17/3295* (2013.01)

(58) Field of Classification Search
None
See application file for complete search history.

(56) References Cited

U.S. PATENT DOCUMENTS

| | | | | |
|---|---|---|---|---|
| 10,217,314 | B2 * | 2/2019 | Thomas | G07F 17/3213 |
| 2015/0213683 | A1 * | 7/2015 | Graham | G07F 17/32 463/25 |
| 2015/0224387 | A1 * | 8/2015 | Lee | A63F 1/00 273/292 |
| 2017/0301178 | A1 * | 10/2017 | Thomas | G07F 17/3213 |

* cited by examiner

*Primary Examiner* — Ronald Laneau
(74) *Attorney, Agent, or Firm* — Mark A. Litman & Associates, P.A.

(57) ABSTRACT

An electronic wagering event is performed on a gaming platform. The wagering event is based upon providing predetermined alignment of virtual symbols within a grid of frames in columns and rows. The processor provides a display of a random distribution of symbols within the frames of the grid on the video display The processor assigns a specific maximum number of symbol transfer steps that the player position may input from the player input controls at the player position. A visual display indicates how symbols are to be transferred within the frames of the grid on the video display to increase winning paylines. Upon exhaustion of the specific maximum number of symbol transfer steps that the player position may input, the processor determining correspondence of symbol distribution within the grids with respect to the paytable and resolves all wagers.

21 Claims, 10 Drawing Sheets

SKILL-ASSISTANCE IN SKILL-BASED WAGERING

RELATED APPLICATION DATA

This application claims priority as a continuation-in-part application from U.S. patent application Ser. No. 15/434,054, filed 16 Feb. 2016 and titled "POSITION-CHANGING ELEMENTS ON A VIDEO SCREEN IN A WAGERING GAME EVENT."

BACKGROUND OF THE INVENTION

1. Field of the Invention

The present invention relates to the field of electronic game wagering, and especially in electronic skill-based game wagering.

2. Background of the Art

In the gaming industry, there are generally two distinct forms of skill on which gaming events are identified. The first is intellectual skill, as performed in poker games, where one player competes against others, which may include the house, as well as other players. Intellectual gaming could also include trivia events and competitions as in "Do You Want to Be a Millionaire?"

There are numerous issues and problems that need to be addressed in the use of either form of skill-based gaming if it is to be legal and acceptable to players.

One problem relates to the fact that some jurisdictions that regulate gambling are amending their regulations to allow new games that let players exercise meaningful skill in the resolution of a slot or electronic game machine wager. These skills can include mental/cognitive-based game mechanics, physical/dexterity game mechanics, or a combination of both mental and dexterity based mechanics. Examples of mental/cognitive based game mechanics include pattern recognition, memory, calculation, and prediction. For example, a slot game may offer players an unarranged or partially arrange array of symbols and require the player to arrange the symbols on a grid to maximize paying lines. Examples of physical/dexterity based game mechanics include accuracy, speed, and strength. An example of a slot game which uses physical skill might be a game that asks players to press a button as quickly as possible when prompted by a visual cue on the screen. An example of a mental/physical hybrid skill game mechanic might involve a game where players are dually rewarded for placing random symbols in the correct order as fast as possible.

The vast majority of wagering games offered in casinos are house-banked. That is, all wagers are collected by the casino and all payouts are made by the casino. Traditional, non-skill slot machines and other electronic gaming machines do not offer the player any meaningful control over the outcome. The player makes the wager and the final result, whether a complete loss, small win, or large jackpot, is determined by the combination of programming and a random number generator embedded in the machine. The games are designed and programmed so that there is always a long-term house (casino advantage). As is said in the industry, those large hotels and casinos are not paid for out of players' winnings.

All house-banked gaming machines are designed, over millions of independent wagers, to pay back less in winnings (the return to player) than they received in wagers. The difference between the percentage returned to player and the total amount wagered is commonly referred to as the house advantage or the house edge. In slot machines, the return to player typically ranges from as high as 99% to as low as 75%.

House-banked skill-based slot machines introduce one or more skill-mechanics for the player to deploy in conjunction with a randomly determined outcome. The player is allowed to use skill, whether mental, physical, or a hybrid of mental and physical, to maximize their odds of winning. Video Poker is an example of an electronic gaming machine that will offer a different theoretical return to player depending on the strategy a player uses. For example, a player using a basic strategy might play video poker at a theoretical return to player of 94% while a skilled player who uses advanced strategy to maximize their probability of winning might play at a theoretical return to player of 98%.

The ability to exercise skill to increase a gambling game's return to player creates incentive for bettors to play. An improvement in a game's return to player will produce an increase in the number of winning hand, an increase in the size of the payout for winning hands, or a combination of both.

Although players can utilize strategy to improve their return to player in video poker and other skill-element gambling games, the maximum return to player is capped by the chance elements of the game.

Patent examples of skill-based games include U.S. Pat. No. 9,754,452 (St. John and Sahl), and U.S. Published application Ser. No. 15/434,054, filed 16 Feb. 2017 and titled POSITION-CHANGING ELEMENTS ON A VIDEO SCREEN IN A WAGERING GAME EVENT (Thomas and Pettie).

Published US Patent Application Document No. 20160071355 for AUTOMATED ASSISTANCE IN SKILL-BASED GAMING (Morrison), describes a system for presenting a skill-based game, the system includes at least one server including a processor configured to execute machine readable code, the machine readable code executable by said processor configured to cause the server to serve a set of matchups of participants of an event, to the plurality of presentation devices, the plurality of presentation devices displaying the set of matchups on a display; receive over the wide area network data from the presentation devices characterizing a set of user selected winners of the matchups made by the users; update the event data pertinent to participants in the actual events; using the updated data to calculate and assign payoffs to the users based on the fixed payoff odds.

One of the challenges in enticing players to try a gambling game that includes an unfamiliar skill element is overcoming their fear that they will exercise the skill component poorly and resulting in a significant loss in money and embarrassment to their friends.

One solution to this problem is to provide new players with the option to receive assistance in the form of hints, larger targets, or simply having the computer execute the skill-component for the players. There are, however, several pitfalls with this approach. If the game provides too much assistance to a player, it removes the excitement factor that comes from observing, learning, and improving the skill element.

SUMMARY OF THE INVENTION

A method of performing an electronic wagering event on a gaming platform that includes, a video display, a processor having memory associated therewith, a set of player input controls at a player position, and a value-in-value out system of providing physical elements to the gaming platform so that the gaming platform recognizes monetary value and credits that monetary value into player credits accessible for wagers on the electronic wagering event against a paytable, wherein:

a) the wagering event is based upon providing predetermined alignment of virtual symbols within a grid of frames in columns and rows;

b) after committing a wager to the electronic wagering event, the processor provides a display of a random distribution of symbols within the frames of the grid on the video display;

c) the processor assigns a specific maximum number of symbol transfer steps that the player position may input from the player input controls at the player position;

d) the player position indicates through the player position how symbols are to be transferred within the frames of the grid on the video display; and e) upon exhaustion of the specific maximum number of symbol transfer steps that the player position may input, the processor determining correspondence of symbol distribution within the grids with respect to the paytable;

wherein, before e) is completed, the processor causes display on the video display of at least one prospective symbol transfer step to assist the player position in obtaining a winning outcome against the paytable.

DETAILED DESCRIPTION OF THE INVENTION

Figure 1A:
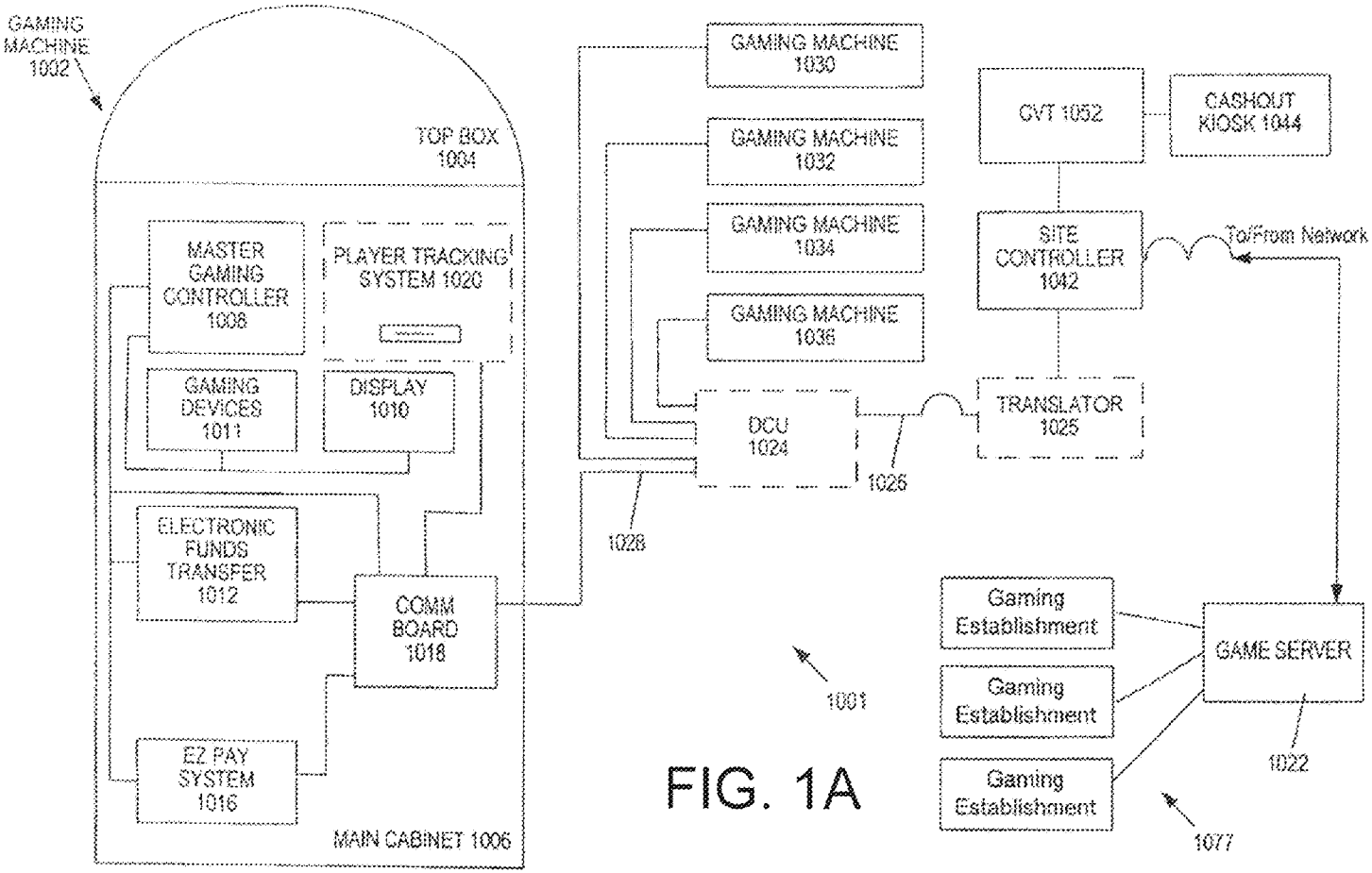
FIG. 1A shows a schematic for an electronic system for enabling play of the gaming method described herein.

The present technology includes a method of performing an electronic wagering event on a gaming platform that includes:

a video display, a processor having memory associated therewith, a set of player input controls at a player position, and a value-in-value out system of providing physical elements to the gaming platform so that the gaming platform recognizes monetary value and credits that monetary value into player credits accessible for wagers on the electronic wagering event against a paytable. In performing the method:

a) the wagering event is based upon providing predetermined alignment of virtual symbols within a grid of frames in columns and rows;

b) after committing a wager to the electronic wagering event, the processor provides a display of a random distribution of symbols within the frames of the grid on the video display;

c) the processor assigns a specific maximum number of symbol transfer steps that the player position may input from the player input controls at the player position;

d) the player position indicates through the player position how symbols are to be transferred within the frames of the grid on the video display; and e) upon exhaustion of the specific maximum number of symbol transfer steps that the player position may input, the processor determining correspondence of symbol distribution within the grids with respect to the paytable.

Before e) is completed, the processor causes display on the video display of at least one prospective symbol transfer step to assist the player position in obtaining a winning outcome against the paytable. The symbol transfers are preferably between only adjacent symbols in adjacent frames. Normally adjacency would be orthogonal frames, but diagonally adjacent frames may also be used. Frames separated by another frame may also be exchanged if the skill-assist indicator provides that option.

The value-in-value-out system may, for example, be selected from the group consisting of currency reader and currency return motor, ticket-in-ticket-out element having a ticket printer within the gaming platform, and a near-field receiver and transmitter that is configured to access a near-filed identification element manipulated at the player position. Preferably, the value-in-value-out system is selected from the group consisting of currency reader and currency return motor, and a ticket-in-ticket-out element having a ticket printer within the gaming platform.

The method may be performed wherein the display of the at least one symbol transfer step to assist the player position is automatically provided on the video display. The display of the at least one symbol transfer step to assist the player position may be provided on the video display only upon input of a request to display assistance entered at the player position, or it may be offered automatically at the beginning of any event, or offered automatically after a timed delay of inactivity by the player. The execution by the player position of the at least one symbol transfer step displayed on the video display as an assist causes a reduction in at least one payout odds available on the paytable. The method of claim 5 wherein execution by the player position of the at least one symbol transfer step displayed on the video display as an assist causes a reduction in at least one payout odds available on the paytable.

The method may have the display on the video display of at least one symbol transfer step to assist the player position comprises an arrow or line on the video display indicating a direction of suggested transfer step for moving symbols displayed on the video display.

The method may be executed wherein the display on the video display of at least one symbol transfer step to assist the player position comprises a variation of image content within at least one frame within the grid on the video display indicating a direction of suggested transfer step for moving at least one symbol displayed on the video display.

In accordance with one embodiment of the invention, certain particularly difficult skill exercises may be removed (by selection of a skill level, specific request by a player (with adjustment of a paytable, based upon simplification of the gaming events), speed requirements in operations, time limits in execution of a gaming event, size of targets, speed at which targets move, number and or complexity of barriers to be overcome or avoided, degree of distinguishability of symbols to be matched or distinguished and the like may be altered in play based upon an evaluation of the real-time selection or ability of players. Evaluation of risk and removal of skill levels may occur in risk assessment engine or skill level determining engine. For example, a card may offer 30 barriers to be overcome or avoided in moving a character through a field of complex events. The first few times a player attempts the game, her/his success may be very low, indicating to the player that his actual skill may not be sufficient for that gaming event. For a next game, the player may input a request (by touchscreen, buttons, voice-activation, personal communication device, slide element on the machine, and the like) to simplify the course on the skill-based wagering event. As a skill is selected, specific paytables 9 which change with the level of skill chosen) may be displayed to fully inform the player of the alteration in payouts from the paytables. When a skill level is chosen, that skill level will be maintained during that session with the player. When the session ends (as by player card removal, cash out of all available credit, or exhaustion of available credit, for example), a default skill level will be returned to.

Again, in view of this selection or request for an altered difficulty of activity, the risk assessment engine may determine that certain barriers, numbers of obstacles, speed through specific areas of a path, the size of targets and the like may be altered or removed from further play at a new skill level. For example, out of a speed shooting event with 60 targets to be hit within 1 minute, the number of targets may be reduced for a constant time period, the time period may be extended, size of targets may be increased, and these changes may be for only some of the obstacles and obstructions and targets, or may be made more uniform across the entire path where the events occur. Thus the barriers may be more spaced in some areas than others, the speed of targets may change, and the like.

The risk assessment engine may include a graphical user interface that allows an operator (player) to view a listing of correlated skill level payouts (wherein a skill level is the selection by a user of a pre-defined number, speed, complexity, difficulty of events, targets, questions, degree of accuracy required, etc. By degree of accuracy, is meant that targets need not be hit with center-cut shots, or even rim shots within specific rings of a target, but may even just be grazed to count as a hit. The relative position of the hits may be part of the skill level, as where a graze might be one point, an outer ring 3 points, and a center cut 5 points. The graphics interface (e.g., shown on the display screen) may show the available skill levels in a table of listed difficulties, and odds associated with each pay level that a player might select from. The riskiest combinations, which might be presented at the top of a listing in the graphical user interface. A risk assessment engine GUI may be local to the risk assessment engine, or a client application may be available to an operator such that the GUI is presented remotely on the presentation device of the operator and the operator can remotely monitor the game and any risk determined by the risk assessment engine. The risk assessment engine may include a set of predefined thresholds or the operator may set a threshold value for each number of picks of potential payout maximums and barrier maximums in number and difficulty. In one embodiment of the invention, the risk assessment engine is configured to highlight and present selection groups above a threshold in the graphical user interface with some indicia, such as highlighting the selection group in red that might be appropriate for the player. The risk assessment engine may also generate alerts, which can be auditory or may generate an e-mail notification to one or more operators that a skill level is apparently inappropriate. The game engine and risk assessment engine may also be heuristic, and if the analytic component of the processor and engines finds that a very highly skilled user has selected a skill level of play that is too easily overcome, the difficulty may shift to a higher level of skill within a selected skill level (e.g., with levels of 1, 2, 3 and 4, with 1 the highest level), even within a level 4 mode of play, a range of difficulty may exist, as with 4a, 4b, 4c and 4d. In general selection of skill level 4, a, b, c and d levels (with a, the most difficult) may be proportionally distributed. The game engine and processor and risk assessment engine may heuristically (after learning that a particular player or session is operating with a high level of skill), at least shift the skill level to be more weighted towards 4a, than 4d, even making all events operate at 4a levels, or 4a, and lesser percentages of 4d<and balance percentages of 4a, 4b, 4c and 4d, to be more weighted towards more difficult events within the selected range of 4. Depending upon the configuration by the operator, the risk assessment engine may automatically close individual skill levels and shift to a higher required skill level, indicating to the player that the higher payouts are being offered as a measure of the player's success at the lower skill levels. This may be done with or without requiring authorization from an operator.

The skill level selections by user playing the skill-based game may be sent from the presentation device of the user through the network connection between the application and the gaming engine. The data received by the gaming engine may include the ID number for the user (as with a player ID or comp card), a description of the selected game and skill level including the number of sub-events (targets, barriers, questions, speed levels, etc.). Thus, the array, skill selection, and even hints available as a component of skill selection may include a pointer to the selected hint or skill level available.

The presentation device might comprise, for example, a desktop computer, a telephone (including cellular, wireless or wired telephones) or smart phone or tablets (such as an iPhone™ or Android™ device), a laptop or notebook computer, tablets or various other devices.

The input device 30 might comprise, for example, a keyboard, mouse, joystick, touch-screen, button(s), trackballs or other devices now known or later configured and which are capable of receiving input from a player on an electronic web-based player. The communication interface is preferably configured to permit information or data to be exchanged from one or more remote device or locations with the presentation device. The one or more communication interface might support wired or wireless communications using various protocols. For example, if the presentation device is a phone (including smart phones) or PDA, the communications might be by 3G, 4G, 5G, IMT, GSM or the like. If the presentation device is a desktop or laptop computer, the communications might be by TCP/IP or the like. Of course, other protocols may be used such as Bluetooth, 802.11xx and the like.

Also, skill assistance would result in virtually all bettors playing at or near the theoretical maximum return to player, which would severely impact the profitability to the casino. In order for skill assistance to work in skill-based slot machines, the player must pay some penalty for receiving assistance in exercising skill in the game. The ensures that the house retains a desirable mathematical edge. It also motivates the player to play the game and try to master the skill so that they may subsequently play the wagering game without the financial penalty active.

The penalty could include: a decrease in the base payout for some or all of the possible outcomes; an increase in the cost to make the wager which is not reflected in the payouts; and/or a commission of a fixed percentage on any amount won.

The method may have the display of the at least one symbol transfer step to assist the player position is automatically provided on the video display, and the at least one system transfer step is specific to the display of a random distribution of symbols within the frames of the grid on the video display in c), and the combination of the display of a random distribution of symbols within the frames of the grid on the video display and the at least one symbol transfer step to assist the player position is automatically provided on the video display are contained in a single template. The use of a single template source for each stored random distribution of symbols provides both reduced memory storage space, allows for lower processing power in operation of the system (as advisory information does not have to be reprocessed with each original symbol display), and increased security in assuring provision of correct advice on each display.

EXAMPLE

The theoretical maximum return to player in a puzzle-based slot game is 98%.

Players who desire to receive assistance in making the puzzle decision in the game have the option to activate skill assist on the touchscreen or by pressing a button, before they make their wager.

The activation of skill assist introduces two changes to the slot game:

1) The game will provide the player with visual indicators such as but not limited to arrows, movement, text that communicates the best way for the player to exercise skill.
2) The paytable is altered, and certain payouts are reduced in value. (Or, alternately, the machines take a % commission of any winning amount).
3) The effect of this combination results in a significant improvement in the player's use of skill while simultaneously reducing the theoretical maximum return to player. This penalty ensures that a player using skill-assist and executing perfect skill will receive a lower return to player compared to a player who does not use with an identical skill level.
4) When players feel that they have sufficiently mastered the skill element of the game, they can opt to turn off the skill-assist feature and the payout penalty is removed. Now, if the player executes high skill, they will be rewarded with bigger wins.

Figures Description

Figure 1B:
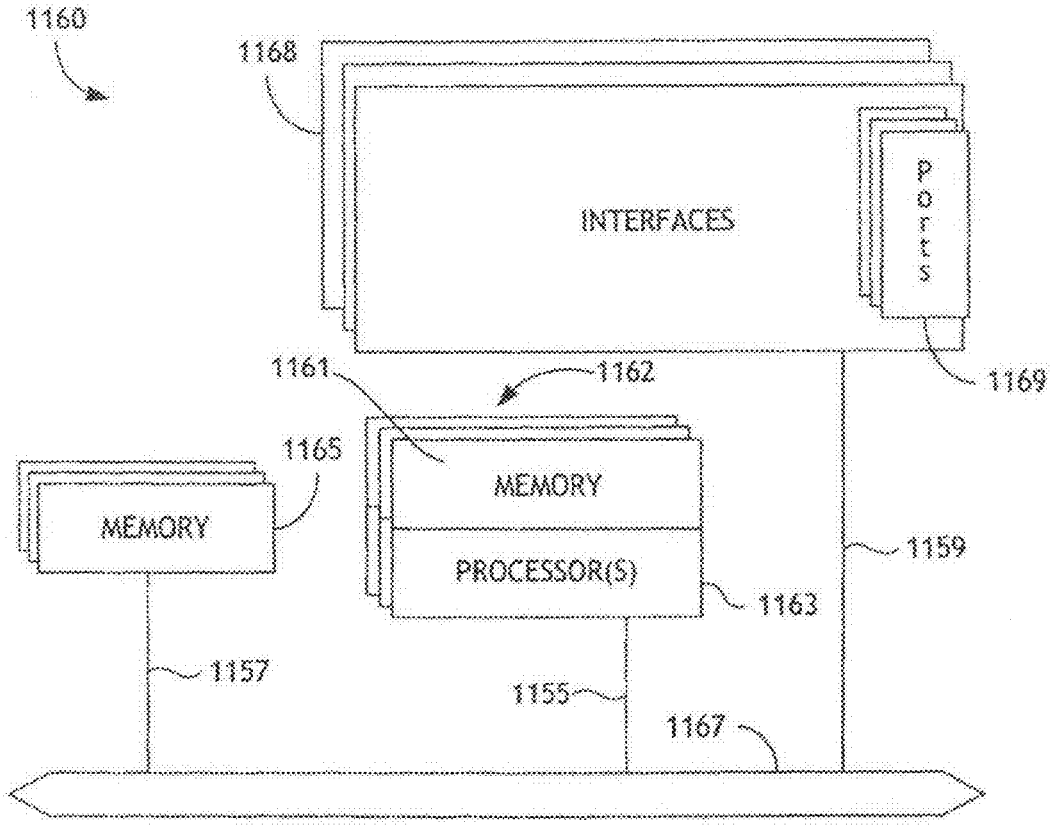
FIG. 1B shows another schematic for an electronic system for enabling play of the gaming method described herein.
Figure 1C:
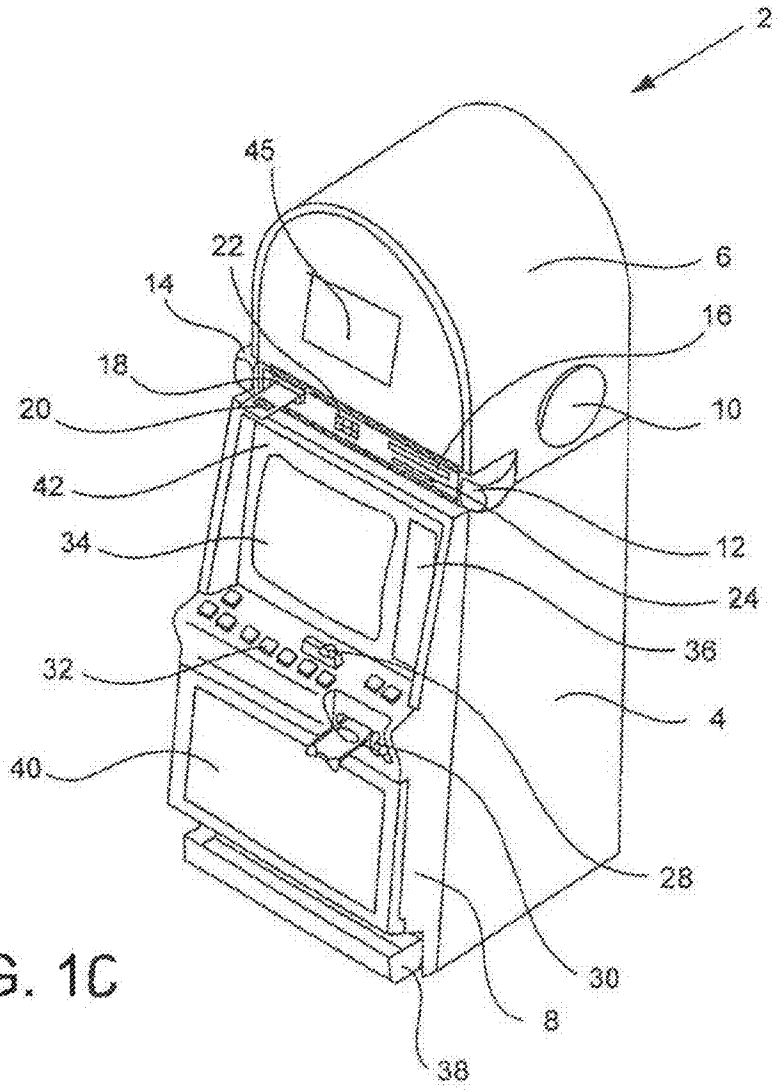
FIG. 1C shows an electronic gaming table on which the gaming method may be executed.
Figure 1:
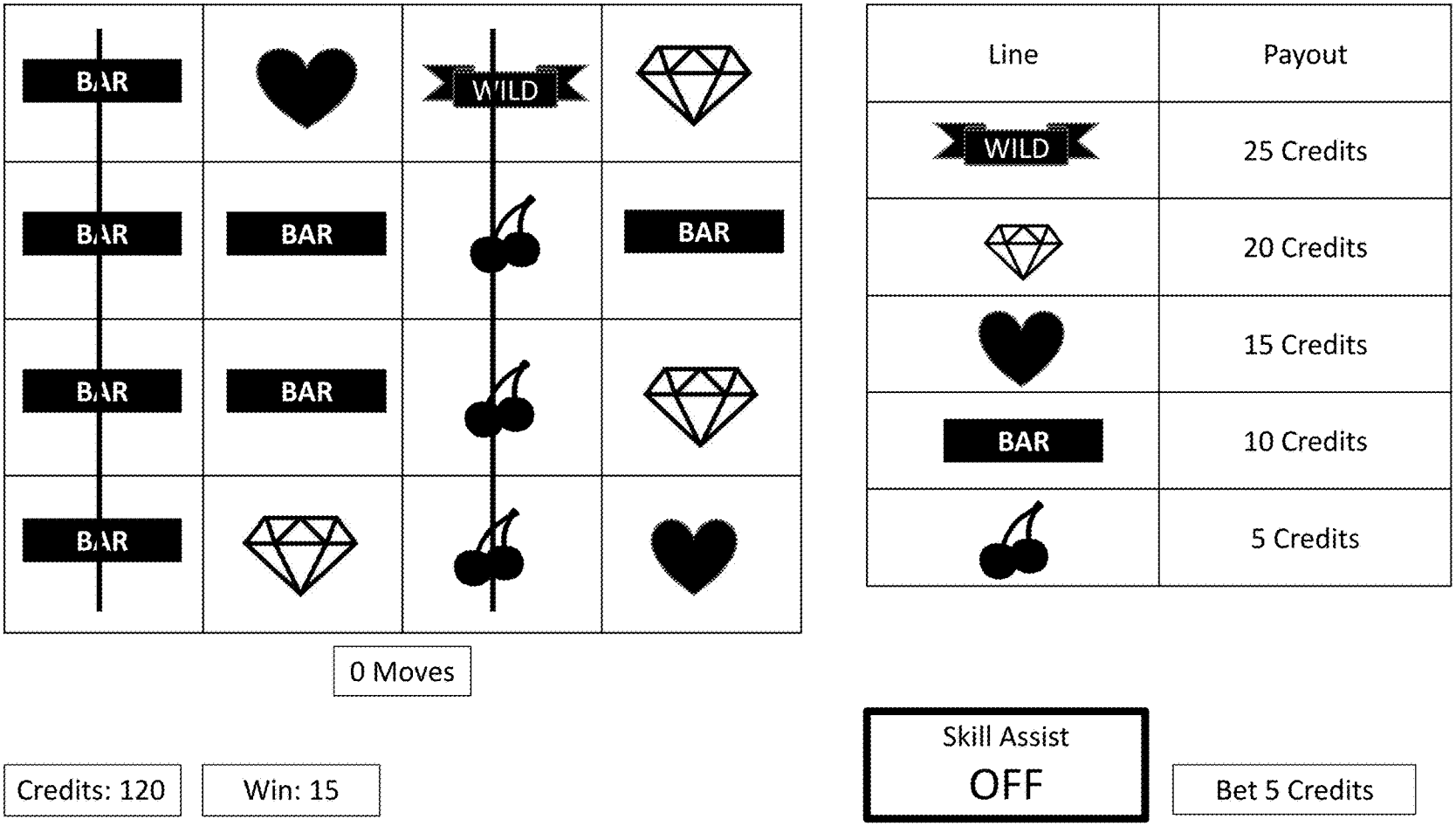
FIG. 1 shows a screen shot of a final result indicating that the skill assist has been turned off. Dark lines through symbols indicate winning paylines.

FIG. 1 shows a screen shot of a final result indicating that the skill assist has been turned off. Dark lines through symbols indicate winning paylines. In this example, the objective of the game is to swap adjacent symbols to make lines of four with a limited number of moves. Skill-assist is not active in this FIG. 1 and the paytable shows specific payouts for each line made without assistance.

Figure 2:
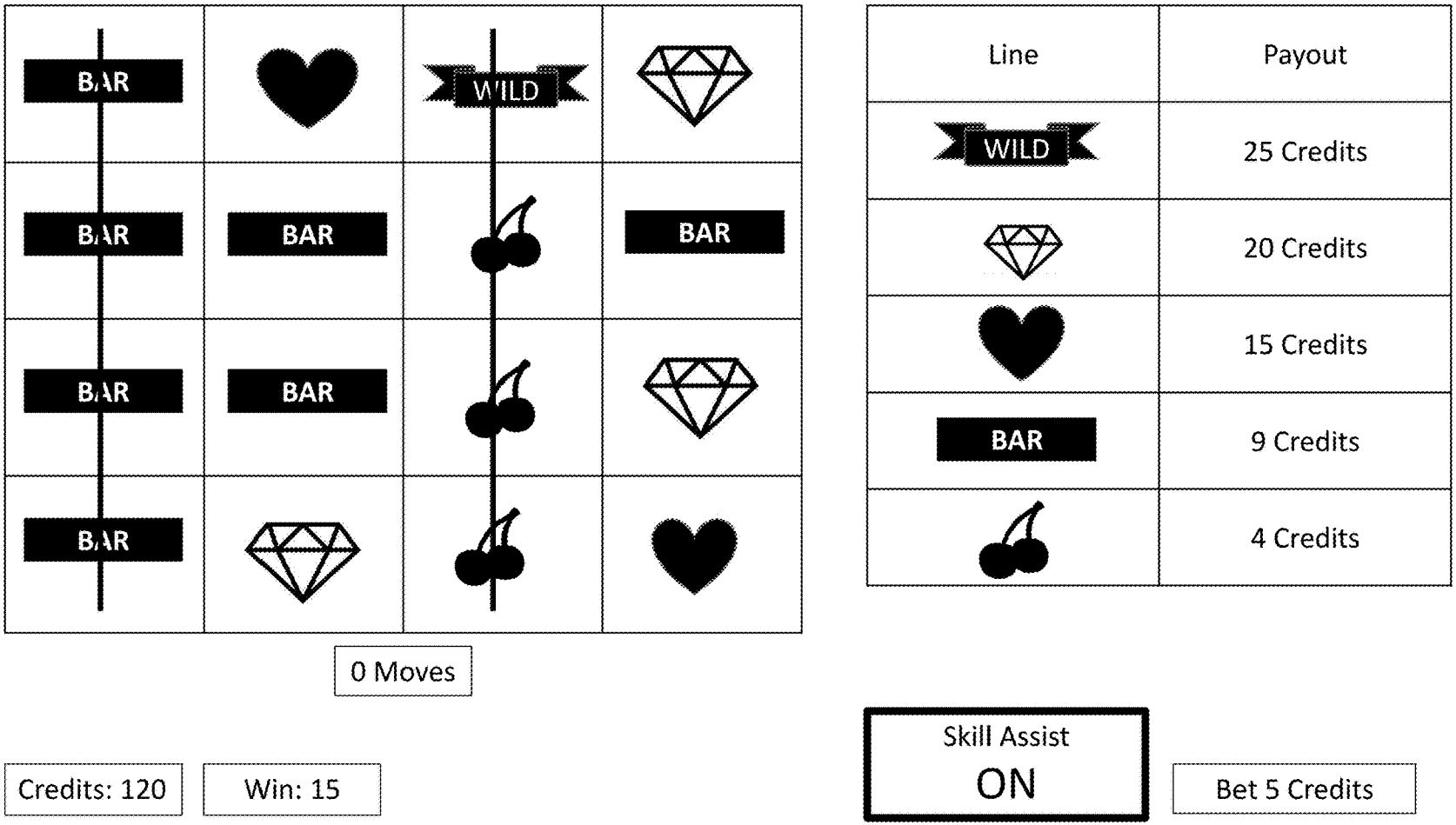
FIG. 2 shows a screen shot of a final result indicating that the skill assist has been turned on. Dark lines through symbols indicate winning paylines. However, the box indicating the number of skill assist moves indicates no moves.

FIG. 2 shows a screen shot of a final result indicating that the skill assist has been turned on. Dark lines through symbols indicate winning paylines. However, the box indicating the number of skill assist moves indicates no moves. Before making the next bet, the player has activated skill-assistance by pressing a button on a player input position. The payout for making a line of 4 cherries decreases (for example) from 5 credits to 4 credits, the payout for making a line of four bars decreases from 10 credits to 9 credits. This decrease in payouts exemplifies a win penalty the player must accept in order to receive skill assist. The tables may further adjust with each successive assist accepted.

Figure 3:
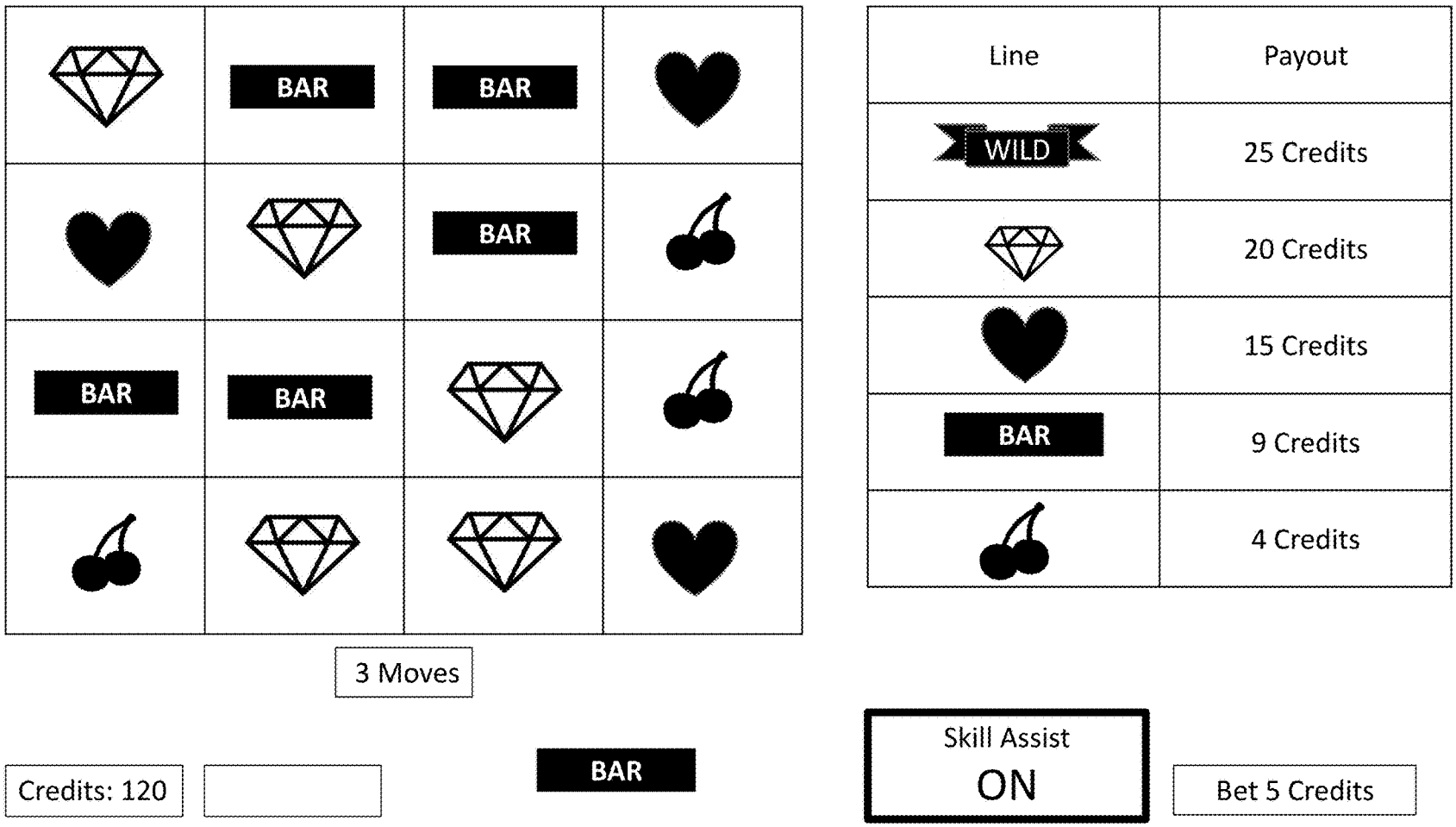
FIG. 3 shows a screen shot of a preliminary result indicating that the skill assist has been turned on. The absence of dark lines through symbols indicate no winning paylines. However, the box indicating the number of skill assist moves indicates three (3) moves.

FIG. 3 shows a screen shot of a preliminary result indicating that the skill assist has been turned on. The absence of dark lines through symbols indicate no winning paylines. However, the box indicating the number of skill assist moves indicates three (3) moves. The player makes a wager with skill assist active. The player receives a random distribution of symbols. The player may make up to three symbol swaps with adjacent symbols in order to make paying lines. Using arrows, skill assist reveals to the player the optimal first swap.

Figure 4:
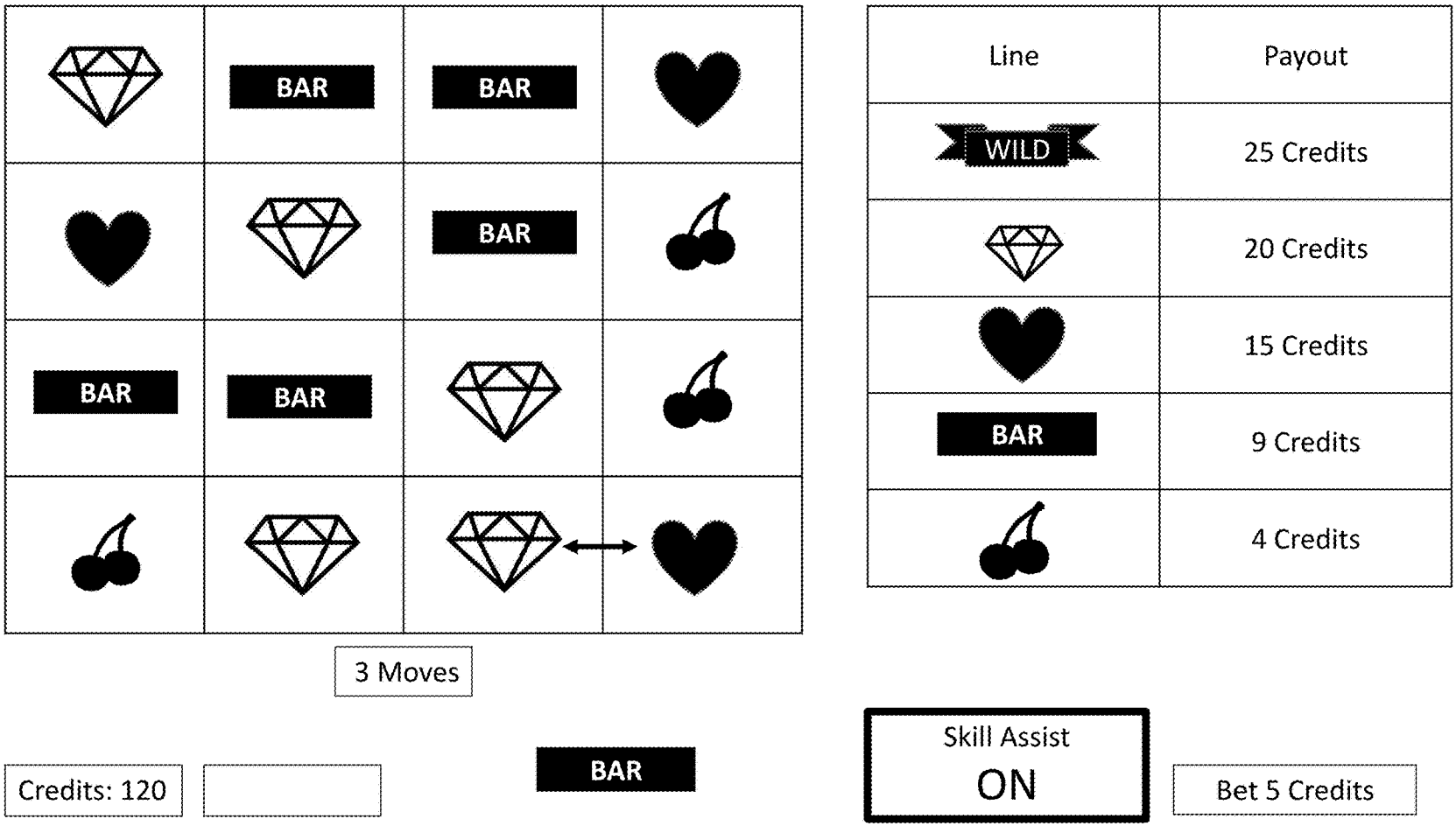
FIG. 4 shows the screen shot of FIG. 3 with an arrow indicating a skill assisted move that would us one of the skill-assist moves available.

FIG. 4 shows the screen shot of FIG. 3 with an arrow indicating a skill assisted move that would us one of the skill-assist moves available. Using arrows, skill assist reveals to the player the optimal $2^{nd}$ swap.

Figure 5:
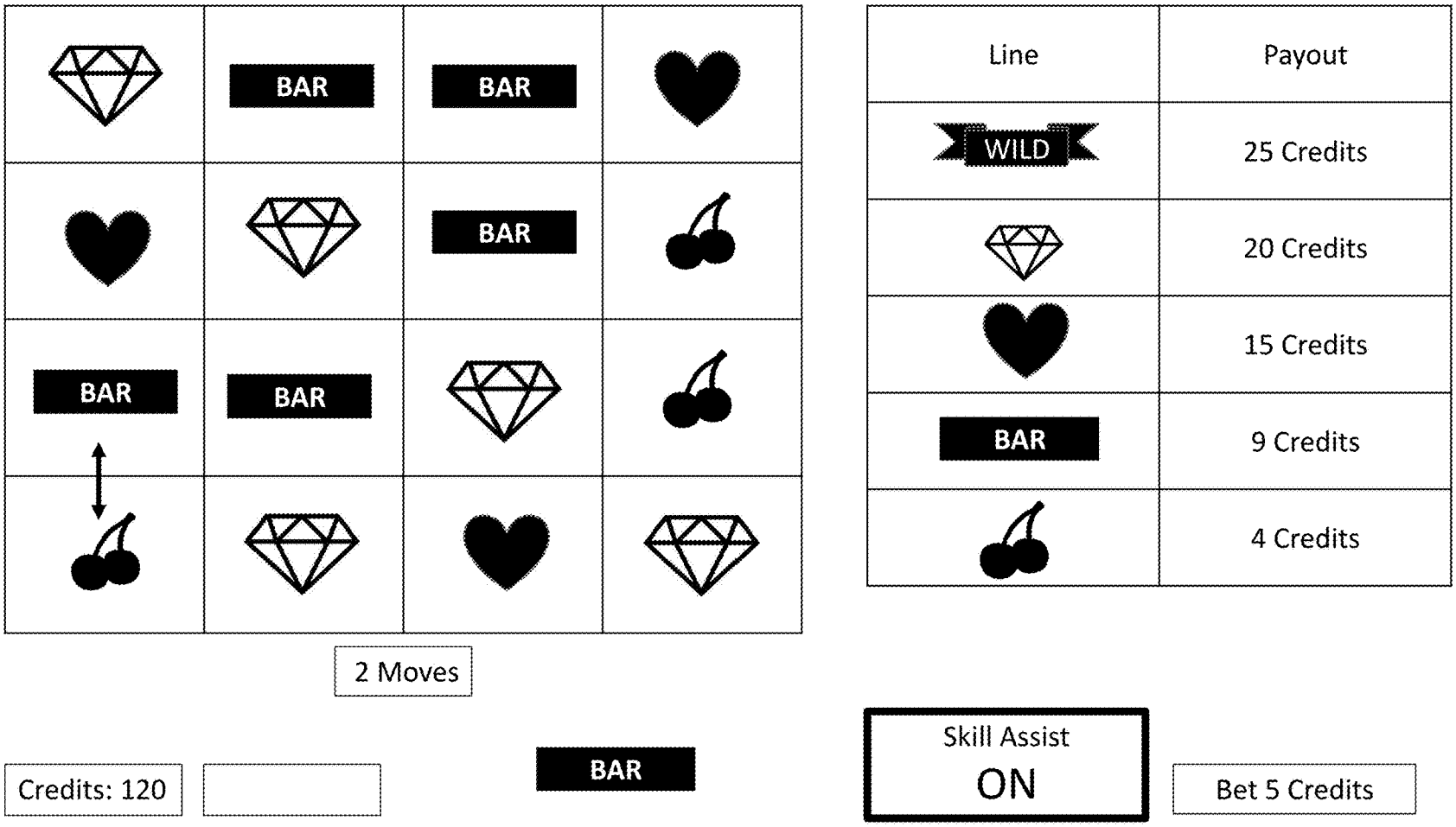
FIG. 5 shows the screen shot of FIG. 4 after accepting the suggested skill-assisted move, with a second displayed skill-assist move suggested and a remaining number of skill-assisted moves indicated as two (2).

FIG. 5 shows the screen shot of FIG. 4 after accepting the suggested skill-assisted move, with a second displayed skill-assist move suggested and a remaining number of skill-assisted moves indicated as two (2). Using arrows, skill assist reveals to the player the optimal $3^{rd}$ swap.

Figure 6:
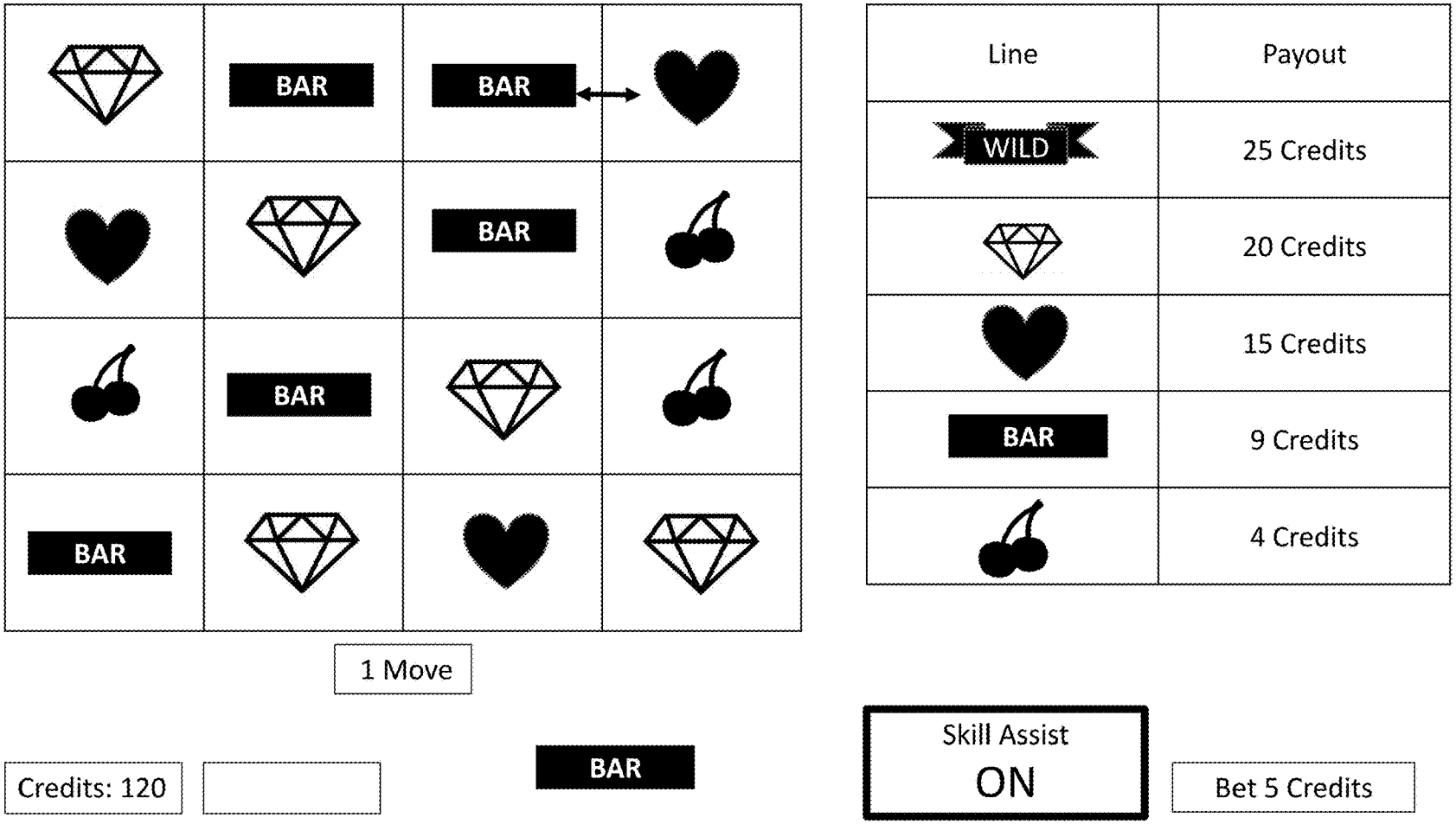
FIG. 6 shows the screen shot of FIG. 5 after accepting the second suggested skill-assisted move, with a third displayed skill-assist move suggested and a remaining number of skill-assisted moves indicated as one (1).

FIG. 6 shows the screen shot of FIG. 5 after accepting the second suggested skill-assisted move, with a third displayed skill-assist move suggested and a remaining number of skill-assisted moves indicated as one (1).

Figure 7:
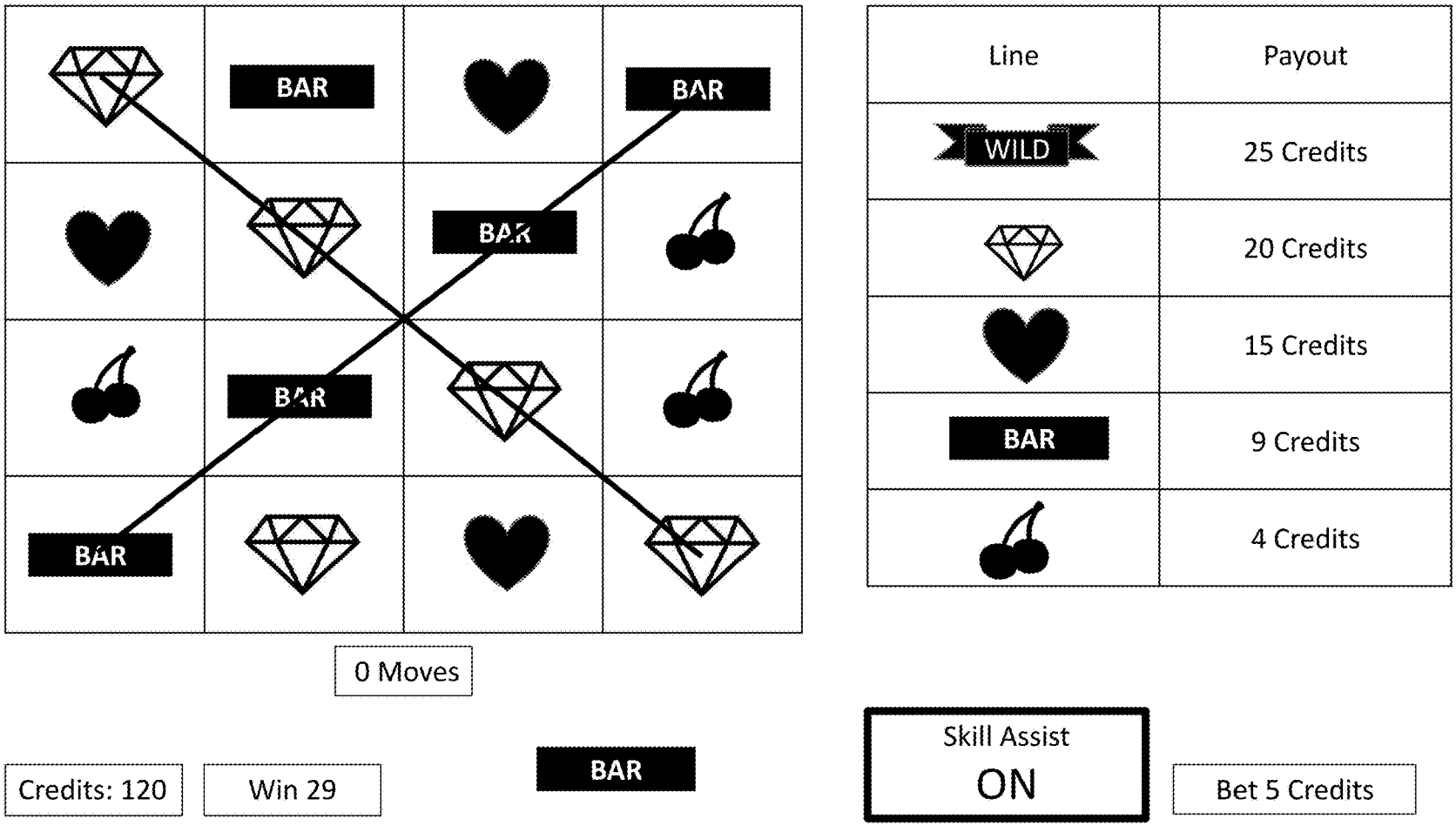
FIG. 7 shows the screen shot of FIG. 6 after accepting the third suggested skill-assisted move, with a remaining number of skill-assisted moves indicated as zero (0). The dark lines indicate winning outcomes on paylines.

FIG. 7 shows the screen shot of FIG. 6 after accepting the third suggested skill-assisted move, with a remaining number of skill-assisted moves indicated as zero (0). The dark lines indicate winning outcomes on paylines. The player has made two paying lines of four symbols in a row and receives a total payout of 29 credits (it should actually be lower because of the level of assistance). Without skill-assist active, the payout for executing the optimal strategy would be 30 credits.

An alternative separate example of using a skill-assist option for a different type of skill-based wagering game. An object is to aim a cursor using a joystick to shoot spheres that fly in the air. The more spheres the player successfully shoots within an allotted amount of time, the greater the win. When the player activates skill-assist, the crosshairs become larger and the size of the targets become larger (making it more likely the player will successfully hit targets).

After the wagering round is over, the player has a commission withdrawn from their total win as a penalty for using the skill-assist option. The withdrawal may be 5%, 10% or more, possibly dependent upon the number of assists taken. With greater number of assists, a larger percentage would be withdrawn.

One embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master™ gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

Chipless Gaming Table Implementation

One enabling system useful in the practice of the present invention is the use of playing cards with Chinese domino symbols which can be distributed for use with a system marketed under the name i-TABLE™ by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game execution events, hand history, and the like. In order to prevent a bet pattern exceeding the number of possible hands in a "live" shoe, a card count will be tracked and the remaining cards will be continually divided by six (the maximum number of cards for a hand). With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) is known in poker style games.

A preferable card handling device for administering a video reel-type-style game is a hand-forming shuffler with integrated card recognition technology, from which playing cards are supplied, with a least a rank/count (and preferable also suit) of individual packs of cards are known before the cards are removed and delivered to player positions and/or the banker position. The card delivery system 102 is in communication with the controller 128 by wired or wireless communication methods. Communication between the various system components is not limited to electronic or electrical signals, but may include optical signals, audio signals, magnetic transmission or the like.

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

Turning next to FIG. 1, a video gaming machine 2 of the present is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown, or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk-screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2. Understand that gaming machine 2 is but one example from a wide range of gaming machine designs on which the present invention may be implemented. For example, not all suitable gaming machines have top boxes or player tracking features. Further, some gaming machines have only a single game display mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs, These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog tinier circuits contain a loadable timeout counter register to allow the operating software to set the timeout interval within a certain range of time. A differentiating feature of some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion, where multiple peripheral devices are connected to a single serial channel.

The serial interfaces may be used to transmit information using communication protocols that are unique to the gaming industry. For example, the Netplex™ system of JOT is a proprietary communication protocol used for serial communication between gaming devices. As another example, SAS is a communication protocol used to transmit information, such as metering information, from a gaining machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

What is claimed:

1. A method of performing an electronic wagering event on a gaming platform that includes, a video display, a processor having memory associated therewith, a set of player input controls at a player position, and a value-in-value out system of providing physical elements to the gaming platform so that the gaming platform recognizes monetary value and credits that monetary value into player credits accessible for wagers on the electronic wagering event against a paytable, wherein:

a) the wagering event is based upon providing predetermined alignment of virtual symbols within a grid of frames in columns and rows;

b) after committing a wager to the electronic wagering event, the processor provides a display of a random distribution of symbols within the frames of the grid on the video display;

c) the processor assigns a specific maximum number of symbol transfer steps that the player position may input from the player input controls at the player position;

d) the player position indicates through the player position how symbols are to be transferred within the frames of the grid on the video display; and e) upon exhaustion of the specific maximum number of symbol transfer steps that the player position may input, the processor determining correspondence of symbol distribution within the grids with respect to the paytable;

wherein, before e) is completed, the processor causes display on the video display of at least one prospective symbol transfer step to assist the player position in obtaining a winning outcome against the paytable.

2. The method of claim 1 wherein the value-in-value-out system is selected from the group consisting of currency reader and currency return motor, ticket-in-ticket-out element having a ticket printer within the gaming platform, and a near-field receiver and transmitter that is configured to access a near-filed identification element manipulated at the player position.

3. The method of claim 1 wherein the value-in-value-out system is selected from the group consisting of currency reader and currency return motor, and a ticket-in-ticket-out element having a ticket printer within the gaming platform.

4. The method of claim 1 wherein the display of the at least one prospective symbol transfer step to assist the player position is automatically provided on the video display.

5. The method of claim 2 wherein the display of the at least one prospective symbol transfer step to assist the player position is automatically provided on the video display, and the at least one system transfer step is specific to the display of a random distribution of symbols within the frames of the grid on the video display in c), and the combination of the display of a random distribution of symbols within the frames of the grid on the video display and the at least one symbol transfer step to assist the player position is automatically provided on the video display are contained in a single template.

6. The method of claim 3 wherein the display of the at least one prospective symbol transfer step to assist the player position is automatically provided on the video display.

7. The method of claim 1 wherein the display of the at least one prospective symbol transfer step to assist the player position is provided on the video display only upon input of a request to display assistance entered at the player position.

8. The method of claim 2 wherein the display of the at least one prospective symbol transfer step to assist the player position is provided on the video display only upon input of a request to display assistance entered at the player position.

9. The method of claim 3 wherein the display of the at least one prospective symbol transfer step to assist the player position is provided on the video display only upon input of a request by player input into the gaming platform to display assistance entered at the player position.

10. The method of claim 1 wherein execution by the player position of the at least one prospective symbol transfer step displayed on the video display as an assist causes a reduction in at least one payout odds available on the paytable.

11. The method of claim 4 wherein execution by the player position of the at least one prospective symbol transfer step displayed on the video display as an assist causes a reduction in at least one payout odds available on the paytable.

12. The method of claim 5 wherein execution by the player position of the at least one prospective symbol transfer step displayed on the video display as an assist causes a reduction in at least one payout odds available on the paytable.

13. The method of claim 6 wherein execution by the player position of the at least one prospective symbol transfer step displayed on the video display as an assist causes a reduction in at least one payout odds available on the paytable.

14. The method of claim 7 wherein execution by the player position of the at least one prospective symbol transfer step displayed on the video display as an assist causes a reduction in at least one payout odds available on the paytable.

15. The method of claim 8 wherein execution by the player position of the at least one prospective symbol transfer step displayed on the video display as an assist causes a reduction in at least one payout odds available on the paytable.

16. The method of claim 9 wherein execution by the player position of the at least one prospective symbol transfer step displayed on the video display as an assist causes a reduction in at least one payout odds available on the paytable.

17. The method of claim 1 wherein the display on the video display of at least one prospective symbol transfer step to assist the player position comprises an arrow or line on the video display indicating a direction of suggested transfer step for moving symbols displayed on the video display.

18. The method of claim 6 wherein the display on the video display of at least one prospective symbol transfer step to assist the player position comprises an arrow or line on the video display indicating a direction of suggested transfer step for moving symbols displayed on the video display.

19. The method of claim 8 wherein the display on the video display of at least one prospective symbol transfer step to assist the player position comprises an arrow or line on the video display indicating a direction of suggested transfer step for moving symbols displayed on the video display.

20. The method of claim 15 wherein the display on the video display of at least one prospective symbol transfer step to assist the player position comprises an arrow or line on the video display indicating a direction of suggested transfer step for moving symbols displayed on the video display.

21. The method of claim 15 wherein the display on the video display of at least one prospective symbol transfer step to assist the player position comprises a variation of image content within at least one frame within the grid on the video display indicating a direction of suggested transfer step for moving at least one symbol displayed on the video display.

* * * * *